United States Patent [19]

Hine

[11] 4,262,619

[45] Apr. 21, 1981

[54] SAILBOAT HIKING STICK AND STABILIZING CLIP

[76] Inventor: Harrison W. Hine, 585 S. Burlingame Ave., Los Angeles, Calif. 90049

[21] Appl. No.: 75,103

[22] Filed: Sep. 13, 1979

[51] Int. Cl.[3] ..... B63H 25/06

[52] U.S. Cl. ..... 114/144 R; 74/480 B

[58] Field of Search ..... 114/144 R, 162, 163; 403/137, 75; 74/480 B, 544

[56] References Cited

U.S. PATENT DOCUMENTS

| | | | |
|---|---|---|---|
| 3,810,440 | 5/1974 | Johnson, Jr. | 114/144 R |
| 3,929,086 | 12/1975 | Alter | 114/144 R |

*Primary Examiner*—Trygve M. Blix
*Assistant Examiner*—Jesus D. Sotelo

[57] ABSTRACT

The hiking stick is made up of first and second telescoping members which may be set in a desired telescoped position to define an overall length. One end of the stick is coupled to the end of the rudder tiller and the other end of the stick terminates in a handle. The use of the stick is simply to facilitate steering of the sailboat, particularly in situations of "coming about" where maintaining a proper hold of the rudder tiller can become awkward in the absence of the stick. The handle of the stick is designed to define an engaging structure for cooperation with a clip arranged to be secured to the tiller. By this arrangement, the handle can be received in the clip to hold the stick in generally parallel overlying position with the tiller and thus in an out-of-the-way location for convenient storage when not in use.

4 Claims, 7 Drawing Figures

SAILBOAT HIKING STICK AND STABILIZING CLIP

This invention relates generally to sailboat accessories and more particularly to a sailboat hiking stick and stabilizing clip.

BACKGROUND OF THE INVENTION

In my U.S. Pat. 3,953,138 issued Apr. 27, 1976 there is shown and described a one-way twist lock structure for telescoping tubes particularly useful, in a preferred application, as a tiller extension stick or hiking stick for sailboat rudders. As shown in this patent, the hiking stick is designed to have one end coupled to the end of a rudder tiller, this coupling permitting rotation of the stick about both horizontal and vertical axes; that is, a universal joint coupling. The other end of the stick terminates in a holding handle and the telescoping locking feature permits an adjustment of the overall length of the stick to provide maximum comfort in using the stick in manipulating the rudder tiller.

While the foregoing structure works well, a problem arises when used on a sailboat rudder tiller in that the hiking stick tends to "flop around" or get in the way when not in use; for example, when the sailboat is simply at anchor. To avoid this problem, a user may simply uncouple the one end of the hiking stick from the tiller itself and then store the stick. When the user decides to go sailing again, he can then reassemble the end of the stick onto the tiller.

The foregoing operations are time-consuming and annoying to a user. It would be far more convenient if the hiking stick could be effectively "stored" without having to disassemble the universal connection joint to the tiller.

BRIEF DESCRIPTION OF THE PRESENT INVENTION

With the foregoing considerations in mind, the present invention contemplates the provision of a sailboat hiking stick in combination with a stabilizing clip, the stick structure itself being similar to that described in the aforementioned United States patent, but being so designed as to cooperate with a clip mounted on the tiller for receiving the handle of the stick and holding the same in a secure position when the stick is not in use. The clipping operation itself involves no moving parts and is very simple to operate all to the end that the inconvenience of a hiking stick getting in the way when not in use is avoided.

As a part of the overall combination, there is included improved telescoping tube locking means to again facilitate adjustment of the overall length of the stick which feature is important to accommodate various positions of the cooperating clip.

Thus, in its broadest aspect, the hiking stick takes the form of an elongated means adapted to be coupled at one end to the end portion of the rudder tiller and terminating at its other end in a handle. This handle includes a first engagement means. A clip is adapted, in turn, to be secured at a desired distance from the end portion of the tiller at least equal to the overall length of the elongated means. This clip has a second engagement means for cooperation with first engagement means to thereby hold the elongated means in a stablized position.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
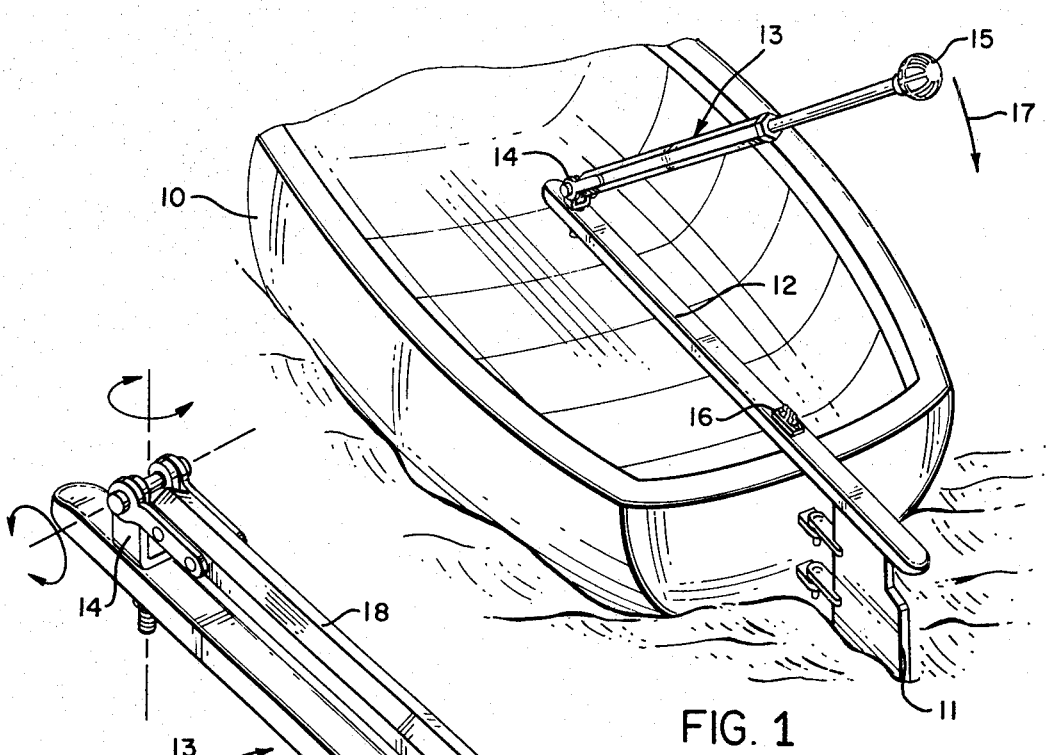
FIG. 1 is a fragmentary perspective view of the stern portion of a sailboat wherein the sailboat hiking stick and stabilizing clip of this invention is illustrated in operation.

Referring first to FIG. 1, there is shown the stern portion of a sailboat 10 provided with a conventional rudder 11 and tiller 12.

The hiking stick in accord with this invention comprises an elongated member 13 adapted to be coupled at one end to an end portion of the tiller 12 by an appropriate universal articulating joint 14. The other end of the member 13 terminates in a handle 15.

As will become clearer as the description proceeds, the handle 15 is designed to define a first engagement means for cooperation with an appropriate clip. In FIG. 1, the clip itself is illustrated at 16 secured to the top of the rudder tiller 12 at a distance from the end portion of the rudder tiller corresponding to a set overall length of the elongated means or hiking stick 13. Clip 16 includes second engagement means for cooperation with the first engagement means on the handle 15 to hold the hiking stick 13 in a stabilized position overlying and parallel to the tiller 12 when not in use.

Towards the foregoing end, the stick 13 can be swung in the direction of the arrow 17 to overlie the top of the tiller and the handle 15 then received in the clip 16.

Figure 2:
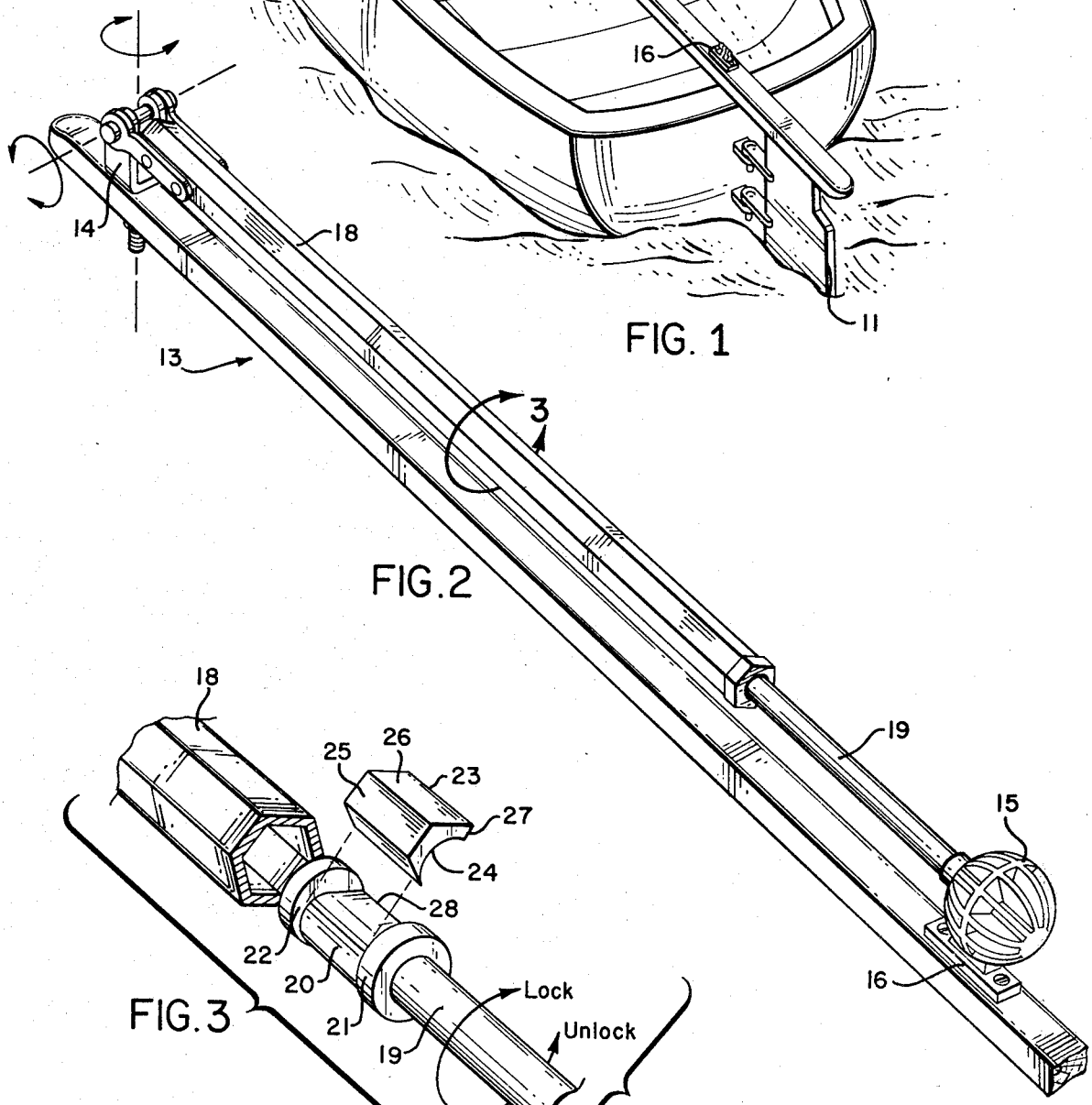
FIG. 2 is an enlarged fragmentary perspective view of the hiking stick of FIG. 1 in a stored position in accord with the present invention.

FIG. 2 illustrates the hiking stick 13 in greater detail wherein the same is shown as comprising first and second telescoping members 18 and 19, the first member being coupled to the rudder by the joint 14 and the second member being telescoped into the first member with the handle 15 on the outer end of this second member. An appropriate locking means is provided on the inner end of the second member 19 responsive to a relative twisting between the first and second members to lock the telescoped position of the second member relative to the first member so that the overall length of the members can be adjusted and locked as desired.

Figure 3:
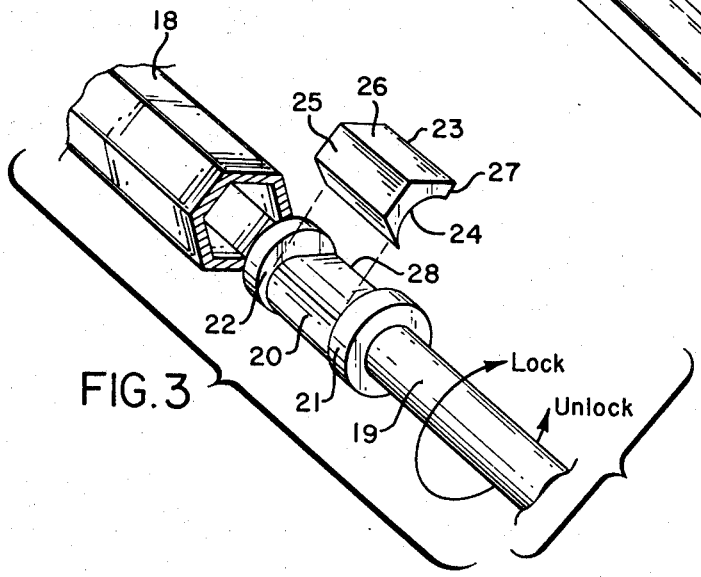
FIG. 3 is an enlarged fragmentary broken away perspective view partly exploded illustrating a locking mechanism incorporated in the area of the circular arrow 3 of FIG. 2.

Referring to FIG. 3, the above-mentioned locking mechanism which is disposed within the first member 18 in the position of the circular arrow 3 of FIG. 2 is shown in the cut-away exploded perspective view. In this view, it will be evident that the first member is hexagonal in cross section. Further, the inner extending end of the second member 19 terminates in an eccentric pin 20 positioned between axially spaced shoulders 21 and 22. A cooperating locking member is shown exploded away at 23 and includes a cylindrical recess 24 on its underside to match the outer cylindrical surface of the pin 20. Locking element 23 also has two flat top surfaces on its top side at 120° to each other which will be juxtaposed to the two adjacent inner surfaces of the hexagonal first member 18 when the various elements are assembled.

A stop surface 27 along one side portion of the element 23 cooperates with a second stop surface 28 extending radially from the eccentric pin 20 between the shoulders 21 and 22. When the stop surfaces 27 and 28 are in face-to-face engagement, the locking element 23 is fully seated between the shoulders 21 and 22 and the member 19 can slide easily within the first member 18 in a telescoping manner.

When the second member 19 is given a twist in a clockwise direction as viewed in FIG. 3, the eccentric pin 20 will cam upwardly on the locking element 23 by way of the engaging surface 24, the locking element 23 being prevented from rotation with the member 19 because of the hexagonal faces on the top surface and inside of the member 18, respectively. The upward camming by the pin 20 will frictionally lock the two members in their set telescoped position.

Twisting of the member 19 in a counterclockwise or opposite direction as indicated by the double-headed arrow in FIG. 3 will permit radial retraction of the locking element 23 until the flat stop surface 27 engages the corresponding surface 28 at which time the locking element 23 is again fully seated between the shoulders and telescoping movement can resume.

In utilizing the hiking stick made up of the two telescoping members as described in FIG. 1, an appropriate overall length can thus be provided by telescoping the members together or further apart and locking the same such that the overall length corresponds to the distance between the clip and the universal joint 14. The handle 15 can then be readily received in the clip as will now be described in detail with respect to FIGS. 4 through 7.

Figure 4:
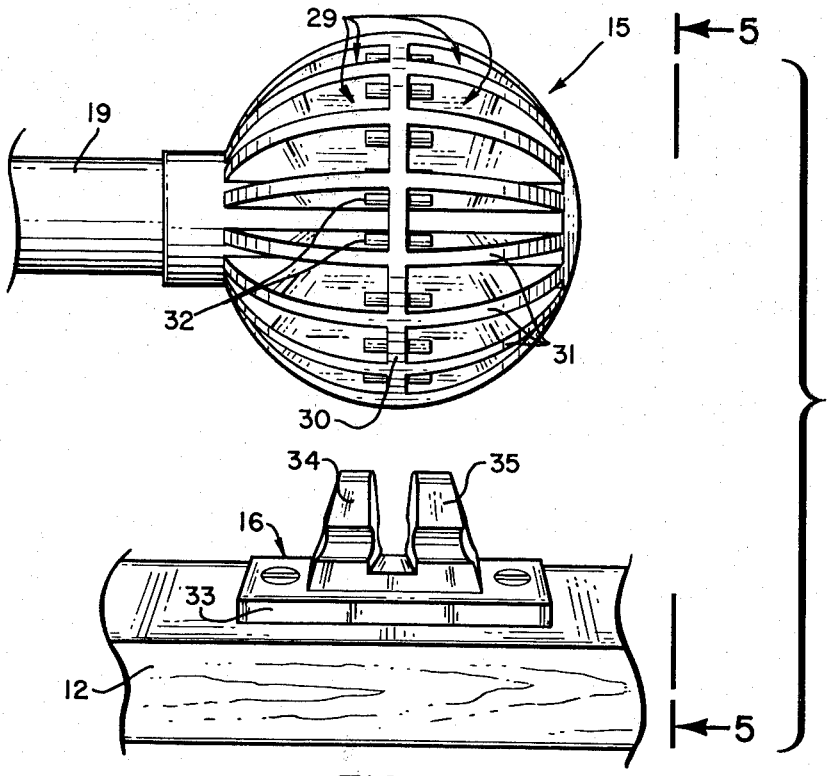
FIG. 4 is an enlarged exploded perspective view of the handle end portion of the hiking stick preparatory to being received in a cooperating clip.

Referring first to FIG. 4, it will be noted that the handle 15 is in the form of a sphere having a plurality of cavities 29 defined between an equatorial partition 30 and north and south running resilient longitudinal partitions 31. At the intersection of each partition with the equatorial partition, there are provided small ribs 32 on opposite sides defining a first engagement means for cooperation with the clip 16.

Clip 16 is shown in fragmentary perspective view below the handle 15 in FIG. 4 as comprising a base plate 33 with upwardly extending posts 34 and 35. Posts 34 and 35 are separated by a distance greater than the thickness of the equatorial partition 30 so that a portion of the equatorial partition can be received between the posts when the handle is to be clipped to the clip.

Figure 5:
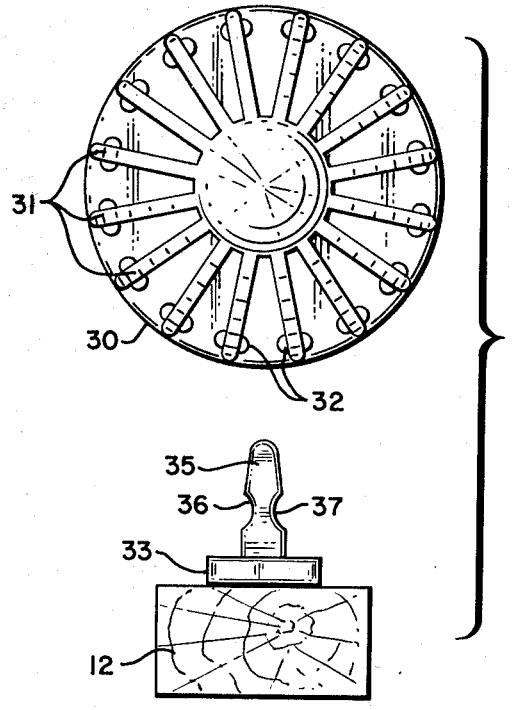
FIG. 5 is another exploded view of the elements of FIG. 4 looking in the direction of the arrows 5—5 of FIG. 4.

With specific reference to both FIGS. 4 and 5, it will be noted that each post has opposed recesses 36 and 37 in its opposite side areas. These recesses define a second engagement means for receiving the ribs 32 on the longitudinal partitions between which the posts are received in a snap-like manner.

Figure 6:
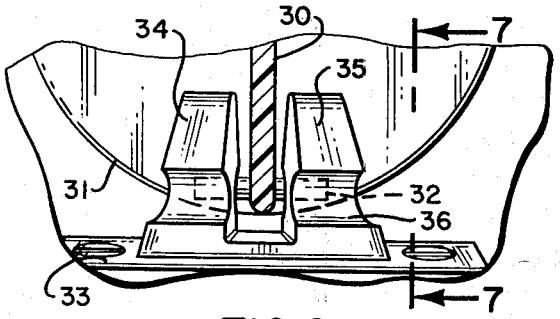
FIG. 6 is a fragmentary perspective view of the elements of FIG. 4 but in their clipped together or "secured" position together.

FIG. 6 illustrates the equatorial partition 30 being received between the post 34 and 35 with ribs 32 received in the back recesses not visible in FIG. 6.

Figure 7:
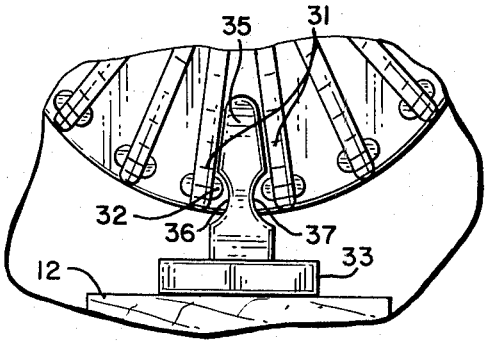
FIG. 7 is a view looking in the direction of the arrows 7—7 of FIG. 6.

FIG. 7 illustrates the post 35 between the north/south longitudinal partitions with the recesses 36 and 37 receiving the ribs 32.

It will be noted that the thickness of the posts from side to side is slightly greater than the distance between the opposed ribs on adjacent longitudinal partitions and the thickness on the post between opposite recesses is less than the distance between opposed ribs. By such dimensioning, the snap-in action will be evident when the post is initially received between the opposed ribs, the post slightly spreading these ribs until they are juxtaposed the recesses wherein they will snap in place. The dimensioning is such that there is provided a certain amount of play after the snap-in action has taken place so that critical adjustment of the overall length of the telescoping members and angle of the plane of the equatorial partition 30 with the plane of the posts is not required in permitting securement of the handle to the clip.

In FIGS. 4 through 7, the clip 16 is shown mounted longitudinally on the top surface of the tiller 12 as illustrated in FIG. 1 in a proper position for receiving the handle 15 when it is desired to store the hiking stick.

From all of the foregoing, the operation of the hiking stick and stabilizing clip will be evident. When it is desired to store the stick as when the boat is at anchor, the telescoping members are adjusted in overall length to correspond to the distance between the end of the tiller 12 and the attachment point of the clip 16 as illustrated in FIGS. 1 and 2. The handle 15 can then readily be snapped into the clip to hold the hiking stick in a stable, out-of-the-way position.

When it is desired to use the stick, it is only necessary to lift up on the handle to unsnap the same. No moving parts are involved in the clipping operation other than the slight spreading of the resilient partition walls as described. Further, the geometry of the handle in the form of the edges of the partitions defining a general spherical shape provide for very easy manual holding thereof. In other words, the plurality of cavities defined for receiving the clip not only makes it simple to effect a fastening of the handle to the clip but in addition provide for convenient gripping areas for a user when manipulating the rudder.

I claim:

1. A hiking stick and stabilizing clip for a sailboat rudder tiller comprising, in combination:

(a) elongated means in the form of first and second telescoping members, the first member being coupled to said rudder tiller and the second member being telescoped within the first member and terminating in a handle on its outer end, said first member being hexagonal in cross section and in which the inner extending end of said second member terminates in axially spaced shoulders having an eccentric pin therebetween, said handle having a first engagement means;

(b) locking means responsive to twisting of said first member within said second member to lock said members in a set telescoped position, said locking means comprising an element receivable between said shoulders and having a cylindrical recess on its underside to match the outer cylindrical surface of said pin, and two flat surface portions at 120° to each other on its top side juxtaposed to adjacent inner surfaces of said hexagonal member, twisting of said second member in said first member in a given direction camming said element radially outwardly to frictionally bind the same against said second member and thereby effect said locking; and, (c) a clip adapted to be secured at a desired distance from said end portion of the tiller at least equal to the overall length of said elongated means, said clip having second engagement means for cooperation with said first engagement means to thereby hold said elongated means in a stabilized position when said handle is brought into engagement with said clip.

2. The subject matter of claim 1, in which said desired position is on said tiller so that when engaged by said handle, said elongated means is held in substantially overlying parallel relationship to said tiller for convenient storage when not in use.

3. A hiking stick and stabilizing clip for a sailboat rudder tiller comprising, in combination: elongated means adapted to be coupled at one end to an end portion of said rudder tiller and terminating at its other end in a handle, said handle having a first engagement means; and a clip adapted to be secured at a desired distance from said one end portion of the tiller at least equal to the overall length of said elongated means said clip having second engagement means for cooperation with said first engagement means to thereby hold said elongated means in a stabilized position when said handle is brought into engagement with said clip, said first engagement means on said handle including resiliently spreadable side walls defining a cavity with opposed ribs adjacent to the entrance edges of the side walls, said second engagement means being defined by a post having recessed areas on opposite sides for receiving said ribs when urged into said cavities.

4. A hiking stick and stabilizing clip for a sailboat rudder tiller comprising, in combination: elongated means adapted to be coupled at one end to an end portion of said rudder tiller and terminating at its other end in a handle, said handle havig a first engagement means; and, a clip adapted to be secured at a desired distance from said end portion of the tiller at least equal to the overall length of said elongated means said clip having second engagement means for cooperation with said first engagement means to thereby hold said elongated means in a stabilized position when said handle is brought into engagement with said clip, said handle being in the form of a sphere having an equatorial partition and north and south running resilient longitudinal partitions to define a plurality of cavities therebetween, each partition at its intersection with said equatorial partition having small ribs on opposite sides defining said first engagement means, said clip having a base plate and upwardly extending posts separated by a distance greater than the thickness of said equatorial partition so that a portion of the equatorial partition can be received between the posts, and each post having opposed recesses in opposite side areas to define said second engagement means for receiving the ribs on the two longitudinal partitions between which the post is inserted, the thickness of the post from side to side being slightly greater than the distance between opposed ribs on adjacent longitudinal partitions and the thickness of the post between opposite recesses being less than the distance between opposed ribs so that when they move towards the recesses as the post is inserted, the partitions are biased apart until the ribs are fully received in the recesses wherein a snap-like action takes place as the partitions move towards their original positions, there being provided some slight play between the rib and the handle after securement is completed.

* * * * *